US006188031B1

(12) United States Patent
Türkmen

(10) Patent No.: US 6,188,031 B1
(45) Date of Patent: Feb. 13, 2001

(54) MOVABLE CONTACT ARRANGEMENT FOR A LOW-VOLTAGE CIRCUIT BREAKER WITH A PIVOT BEARING

(75) Inventor: Sezai Türkmen, Berlin (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/242,520

(22) PCT Filed: Aug. 21, 1997

(86) PCT No.: PCT/DE97/01868

§ 371 Date: Dec. 10, 1999

§ 102(e) Date: Dec. 10, 1999

(87) PCT Pub. No.: WO98/08240

PCT Pub. Date: Feb. 26, 1998

(30) Foreign Application Priority Data

Aug. 21, 1996 (DE) ..... 196 35 366

(51) Int. Cl.[7] ..... H01H 1/22
(52) U.S. Cl. ..... 200/244; 335/16; 218/22
(58) Field of Search ..... 335/16, 147, 195; 218/22; 200/245, 244, 246

(56) References Cited

U.S. PATENT DOCUMENTS

Re. 35,507 * 5/1997 Uchida et al. ..... 335/16
3,523,261 * 8/1970 Bianchi et al. ..... 335/16
4,490,593 12/1984 Cook .
5,313,180 * 5/1994 Vial et al. ..... 335/16
6,100,490 * 8/2000 Turkmen ..... 218/22

FOREIGN PATENT DOCUMENTS 38 02 183 8/1989 (DE) .
295 03 327 U 4/1995 (DE) .
44 16 105 5/1995 (DE) .
0 358 286 3/1990 (EP) .

* cited by examiner

*Primary Examiner*—Michael L. Gellner
*Assistant Examiner*—Nhung Nguyen
(74) *Attorney, Agent, or Firm*—Kenyon & Kenyon

(57) ABSTRACT

A movable contact arrangement for a low-voltage circuit breaker which has a contact lever bracket equipped with contact levers and may move around a pivot bearing for opening and closing the circuit breaker. A journal, which engages with a bearing opening close to an inner end of a stationary conductor segment, is molded onto a main arm of the contact lever bracket. The journal is positioned more or less in the center and has a length that does not exceed the width of the contact arrangement. The bearing opening is also positioned within the width of the contact arrangement. This reduces the width of the circuit breaker, especially in multipole designs, while simultaneously improving the load carrying capacity and service life of the pivot bearing.

4 Claims, 3 Drawing Sheets

MOVABLE CONTACT ARRANGEMENT FOR A LOW-VOLTAGE CIRCUIT BREAKER WITH A PIVOT BEARING

FIELD OF THE INVENTION

The present invention relates to a movable contact arrangement for a low-voltage circuit breaker having contact levers and a contact lever bracket holding the contact levers as well as a stationary conductor segment connected to the contact levers by flexible conductors, with the contact lever bracket movable around a pivot bearing, located in the region of the stationary conductor segment, which includes a journal molded onto the contact lever bracket and a stationary bearing opening positioned in a housing section of the low-voltage circuit breaker.

BACKGROUND INFORMATION

A contact arrangement of this type is described in German Patent No. 44 16 105. FIG. 5 of the specification shows a supplementary view of a contact lever bracket 2, equipped with a contact lever 1, of a circuit breaker described in German Patent No. 44 16 105. According to this description, both lateral bearers 3 of contact lever bracket 2 are provided with a journal 4, projecting to the outside, which engages bearing opening 5 of a housing section 6 (truncated in the illustration) of the circuit breaker. With a multipole circuit breaker design, this arrangement takes up a certain amount of space along a width. Partitions 7 (truncated in the illustration) between adjacent poles must therefore have a width corresponding to an axial depth of both bearing openings, plus a sufficient amount of clearance. The described pivot bearing design therefore affects the width of the circuit breaker.

Other conventional arrangements exist for the pivotable bearing assembly of the movable contact arrangement of a low-voltage circuit breaker. For example, German Patent No. 38 02 183 describes an arrangement in which the contact lever bracket is pivotably attached to the stationary conductor segment by a bearing pin. In this arrangement, lateral bearers of the contact lever bracket project over the stationary conductor segment, which, just like the conventional arrangement described in German Patent No. 44 16 105, also increases the width of the movable contact arrangement beyond the size required for electrical rating. Pivot bearings for movable contact arrangements that require no or only a very slight lateral projection over the stationary conductor segment are also known. One pivot bearing of this type, which is designed as an articulated current transfer arrangement, is described, for example, in U.S. Pat. No. 4,490,593. In contrast to a contact arrangement according to the present invention, each individual contact lever in this arrangement is provided with a bearing pin. Together with helical springs as the sliding element, this bearing pin also forms a means for transferring current. The production of the bearing opening requires a relatively expensive method for machining the stationary conductor segment. Due to their fluctuating electrical contact resistance, articulated current-transfer arrangements are also not suitable for all low-voltage circuit breaker applications.

SUMMARY OF THE INVENTION

An object of the present invention is to provide a sturdy pivot bearing for the contact lever bracket, which does not require the width of the contact arrangement to be increased beyond the size needed for electrical rating purposes.

According to the present invention, this object is achieved in that the contact lever bracket has only one more or less centrally positioned journal with a length not exceeding the width of the movable contact arrangement, and at least one bearing opening is also located within the width of the movable contact arrangement, with the bearing being formed by interacting recesses and surfaces of two separable units of the low-voltage circuit breaker.

According to the present invention, no lateral projection of the pivot bearing over the stationary conductor segment needs to be taken into account, with the result that partitions between adjacent poles need to be only as thick as necessary for electrical insulation purposes. This advantageously reduces the circuit breaker dimensions. However, this advantage is not achieved at the expense of the mechanical reliability of the pivot bearing. Instead, a much larger supporting width is available for the journal, which has a positive effect on the service life and reliability of the circuit breaker.

The bearing opening is formed by interacting recesses and surfaces of two separable units of the low voltage circuit breaker. The complete bearing openings are produced in this manner only after the house section is assembled, which makes mounting the contact lever bracket much easier. One unit may be formed by the housing section of the circuit breaker, and the other unit by the stationary conduction segment which at least partially covers the recess.

A pivoting angle of the contact lever bracket when opening and closing the circuit breaker is relatively small. It is therefore possible to design an entire end area of the contact lever bracket as a journal. According to the present invention, however, a main arm of the contact lever bracket holding the journal may be designed so that it tapers in the direction of the pivot bearing, thus dividing the journal into two lateral journal areas, with each journal area assigned a bearing opening. This arrangement achieves the largest possible supporting width, thus providing a low-tolerance bearing assembly at a relatively low cost.

Unlike the usual pairing of a cylindrical journal with a cylindrical bearing opening, it may be more useful for the purposes of the present invention to give the one or more bearing openings a polygonal cross section. Possible shapes include, for example, rectangular, hexagonal, and octagonal cross sections. With the common methods used for producing plastic housings, these shapes may be easier to produce than cylindrical bearing openings, while they also make it possible to store a supply of lubricant that is sufficient for the entire planned service life of the circuit breaker.

The one or more bearing openings can be formed in the conventional manner by the interacting recesses and surfaces of two separable units of the low-voltage circuit breaker. The complete bearing openings are produced in this manner only after the housing section is assembled, which makes mounting the contact lever bracket much easier. One unit may be formed by the above-mentioned housing section of the circuit breaker, and the other unit by the stationary conductor segment which at least partially covers the recess.

BRIEF DESCRIPTION OF THE DRAWINGS

The basis of the embodiment illustrated in the figures.

DETAILED DESCRIPTION

Figure 1:
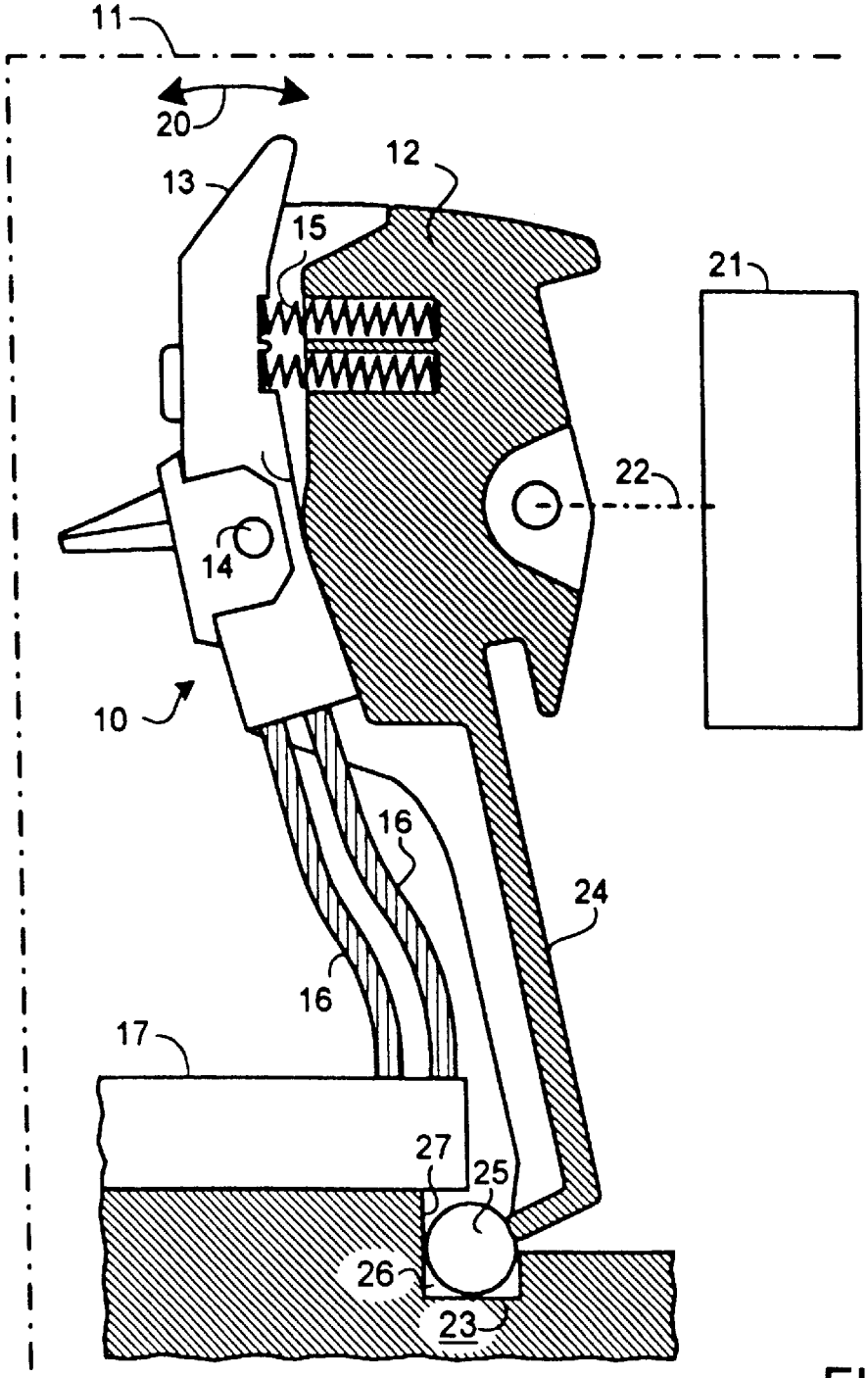
FIG. 1 shows a movable contact arrangement in a partially cut away side view.

FIG. 1 illustrates an axial view of movable contact arrangement 10 of a low-voltage circuit breaker 11, which is merely outlined in the illustration. Contact arrangement 10 includes a contact lever bracket 12, which may be designed in one or more pieces and may be made entirely or partially of insulating plastic. Multiple parallel contact levers 13 are preferably attached to contact lever bracket 12 by a bearing pin 14. Contact springs 15 exert a pre-tension force on contact lever 13 in the direction of a stationary switching contact, which is not shown in FIG. 1 in order to simplify the representation. Reference is thus made to German Patent No. 44 16 105, which describes a complete conducting path of a low-voltage circuit breaker, including a corresponding arc-quenching chamber.

Contact levers 13 are connected by a flexible stranded conductor 16, or by multiple stranded conductors, to a stationary conductor segment 17, which may be designed, as a lower connecting bar which extends out of a housing of circuit breaker 11. Together with an upper connecting bar positioned more or less opposite contact levers 13 (see German Patent No. 44 16 105 mentioned above), contact levers 13, stranded conductors 16, and lower stationary conductor segment 17 form the conducting path of one pole of circuit breaker 11.

To open and close the circuit breaker, contact lever bracket 12 executes a pivoting motion indicated by a two-way arrow 20, which is initiated by a schematically illustrated drive 21. For this purpose, drive 21 is connected to contact lever bracket 12 by an articulated coupler 22 on a back of the bracket opposite contact levers 13. A pivot bearing designated in its entirety by 23 for contact lever bracket 12 is located close to stationary conductor segment 17 and includes a cylindrical journal 25 positioned at the bottom end of a main arm 24 of contact lever bracket 12 as well as at least one bearing opening 26.

Figure 2:
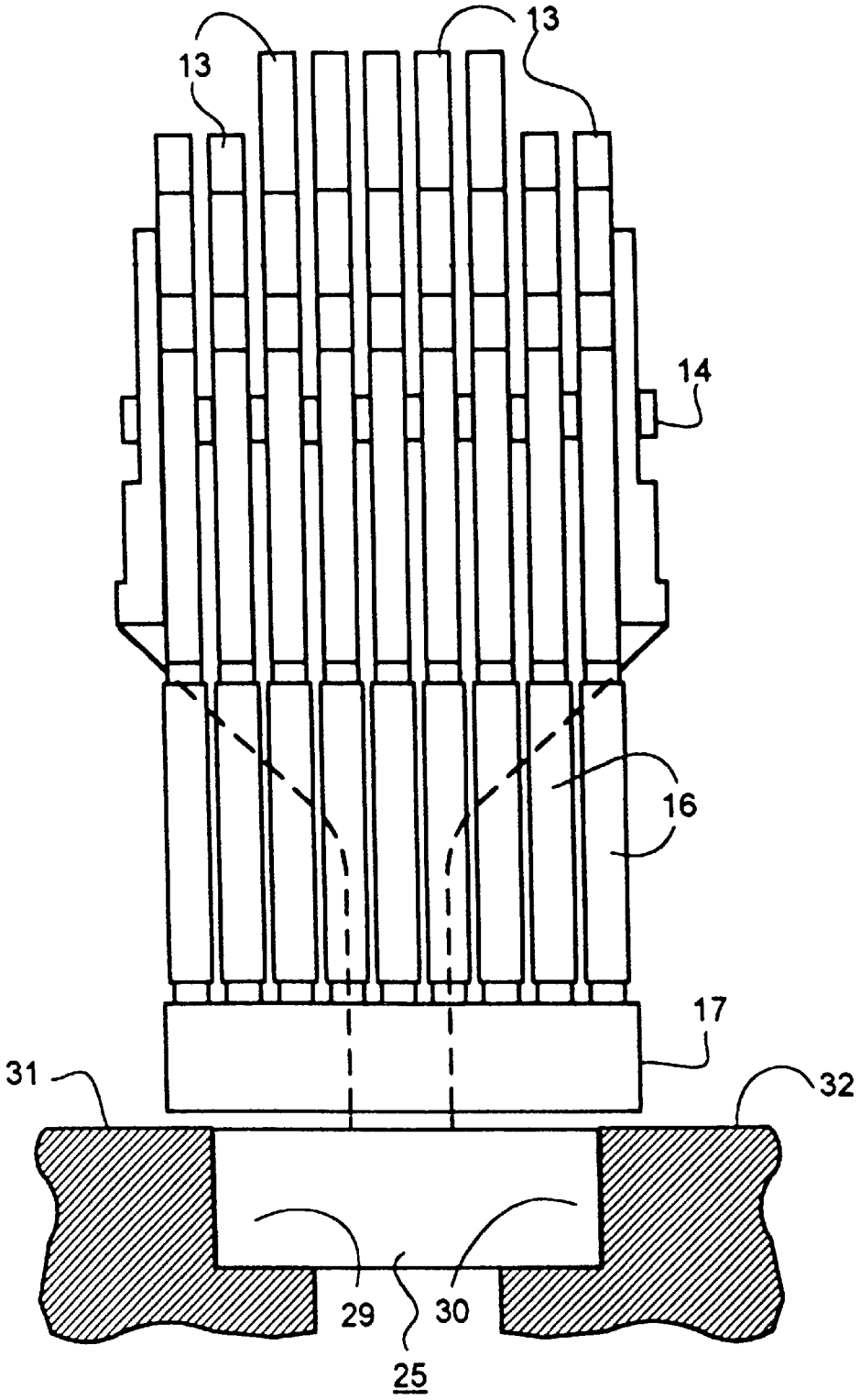
FIG. 2 shows the contact arrangement illustrated in FIG. 1 with a view of the contacting side of contact levers.

As mentioned above, the journal can take up the entire available width of contact arrangement 10, which largely corresponds to the width of stationary conductor segment 17. As shown in greater detail in FIG. 2, however, main arm 24 of contact lever bracket 12 may also be designed so that it tapers in the direction of journal 25, as shown by the dotted lines. This forms two lateral journal areas 29 and 30, to each of which is assigned a separate bearing opening 31 and 32.

Regardless of whether one continuous bearing opening or two separate bearing openings are provided, these bearing openings may be incorporated in different ways into the layout of circuit breaker 11. In the example shown in FIG. 1, bearing opening 26 is almost completely incorporated into a housing section 27 (e.g, a first unit of two separable units) and is formed by a recess 28 with a rectangular cross section in conjunction with conductor segment 17 (e.g., a second unit of the two separable units). The depth of recess 28 corresponds at least to a diameter of journal 25. Conductor segment 17 covers recess 28 only partially and only to the extent that it prevents journal 25 from leaving bearing opening 26. The arrangement has the advantage that contact lever bracket 12 is released together with conductor segment 17, thereby simplifying assembly and disassembly during production and maintenance.

Figure 3:
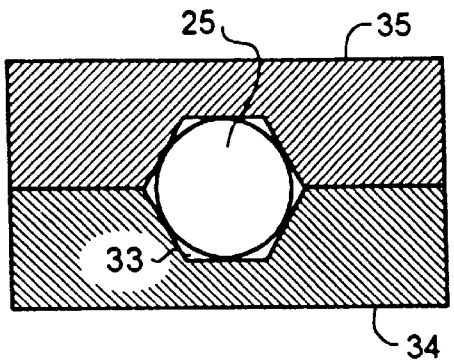
FIG. 3 shows a detail of bearing openings.
Figure 4:
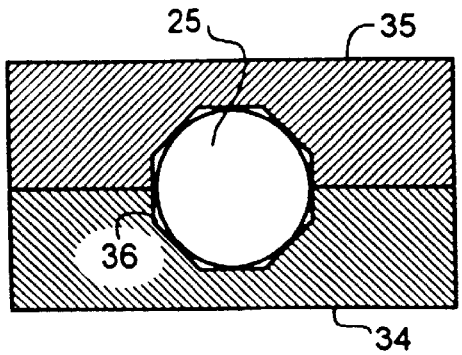
FIG. 4 shows a second detail of bearing openings.
Figure 5:
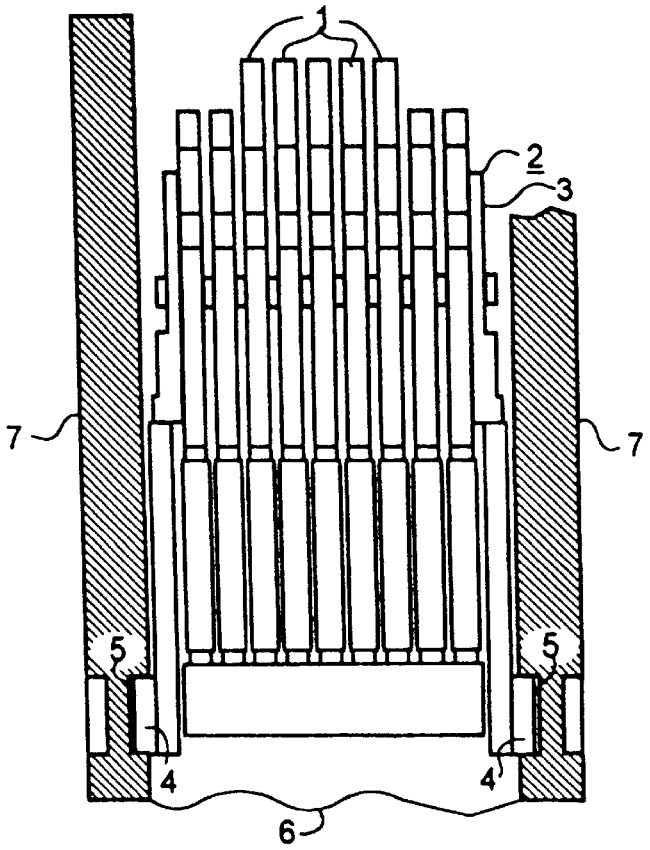
FIG. 5 shows a contacting side of contact levers of a conventional movable contact arrangement according to German Patent No. 44 16 105.

While bearing opening 26 shown in FIG. 1 has a more or less rectangular cross section, other polygonal cross sections may also be advantageous. For example, FIG. 3 shows a bearing opening 33 with a hexagonal cross section, which is formed by symmetrical recesses in two joined housing sections 34 and 35. Similarly, a bearing opening 36 with an octagonal shape may also be used, as shown in FIG. 4.

In the embodiment shown in FIG. 1, pivot bearing 23 is located close to and beneath the inner end of conductor segment 17. Obviously, other arrangements in the region of conductor segment 17 are also possible, e.g. along the length of or directly above conductor segment 17. In these cases, conductor segment 17 cannot be used to cover or limit the associated bearing opening. Instead, it is advisable to use an arrangement according to FIGS. 3 and 4, in which the bearing openings are limited by two housing sections.

What is claimed is:

1. A movable contact arrangement for a low-voltage circuit breaker, comprising:

contact levers coupled to a stationary conductor segment via flexible conductors; and a contact lever bracket holding the contact levers, the contact lever bracket being movable around a pivot bearing, the pivot bearing being positioned in a region of the stationary conductor segment and including only one substantially centrally located journal and at least one stationary bearing opening, the centrally located journal being molded onto the contact lever bracket and having a length not exceeding a width of the movable contact arrangement, the at least one stationary bearing opening being positioned within the width of the movable contact arrangement and in a housing section of the low-voltage circuit breaker, the at least one stationary bearing further being formed by interacting recesses and surfaces of two separable units of the low-voltage circuit breaker.

2. The movable contact arrangement according to claim 1 wherein a first unit of the two separable units is formed by the housing section and a second unit of the two separable units is formed by the stationary conductor segment at least partially covering the at least one stationary bearing opening.

3. The movable contact arrangement according to claim 1 wherein the contact lever bracket includes a main arm, the main arm tapering in a direction of the centrally located journal, the centrally located journal being divided into two lateral journal areas, each of the two lateral journal areas assigned one of the at least one stationary bearing opening.

4. The movable contact arrangement according to claim 1 wherein the at least one stationary bearing opening has a polygonal cross section.

* * * * *